US011211724B2

(12) United States Patent
Reiter et al.

(10) Patent No.: US 11,211,724 B2
(45) Date of Patent: Dec. 28, 2021

(54) SMALL FORM FACTOR POWER CONVERSION SYSTEM

(71) Applicant: CORE TECHNOLOGIES LLC, Fairmont, MN (US)

(72) Inventors: Andrew Reiter, Fairmont, MN (US); Ernest Wittenbreder, Flagstaff, AZ (US)

(73) Assignee: CORE TECHNOLOGIES LLC, Fairmont, MN (US)

( * ) Notice: Subject to any disclaimer, the term of this patent is extended or adjusted under 35 U.S.C. 154(b) by 901 days.

(21) Appl. No.: 15/338,202

(22) Filed: Oct. 28, 2016

(65) Prior Publication Data

US 2017/0149347 A1 May 25, 2017

Related U.S. Application Data

(60) Provisional application No. 62/248,944, filed on Oct. 30, 2015.

(51) Int. Cl.

| | |
|---|---|
| ***H01R 12/71*** | (2011.01) |
| ***H01R 13/62*** | (2006.01) |
| ***H01R 31/06*** | (2006.01) |

(52) U.S. Cl.
CPC ..... *H01R 12/716* (2013.01); *H01R 13/6205* (2013.01); *H01R 31/065* (2013.01)

(58) Field of Classification Search
CPC .. H02M 2001/007; H02M 1/42; H02M 7/003; H02M 7/04; H02M 7/06; H02M 7/217; H05K 1/181; H05K 1/183; H01R 12/716; H01R 12/777; H01R 12/88; H01R 13/05; H01R 13/6205; H01R 31/06
See application file for complete search history.

(56) References Cited

U.S. PATENT DOCUMENTS

| | | | | |
|---|---|---|---|---|
| 5,838,554 | A * | 11/1998 | Lanni | H01R 13/6675 363/141 |
| 6,091,611 | A * | 7/2000 | Lanni | H02J 7/0008 307/151 |
| 8,712,482 | B2 | 4/2014 | Sorias et al. | |
| 8,712,486 | B2 | 4/2014 | Sorias et al. | |
| 8,988,043 | B2 | 3/2015 | Alammari | |
| 9,088,670 | B2 | 7/2015 | Sorias et al. | |
| 9,130,384 | B2 * | 9/2015 | Pliner | H02J 7/0042 |
| 9,318,834 | B2 * | 4/2016 | Hsu | H01R 24/68 |
| 2003/0228792 | A1 * | 12/2003 | Lanni | H01R 31/065 439/528 |
| 2013/0052871 | A1 * | 2/2013 | Eklind | H04M 1/04 439/620.21 |

(Continued)

OTHER PUBLICATIONS

Screenshots of product search for ceramic capacitrors, conducted through Digi-Key Electronics website. Search performed on Aug. 9, 2018 at https://www.digikey.com/products/en/capacitors/ceramic-capacitors/60.*

*Primary Examiner* — Fred E Finch, III
(74) *Attorney, Agent, or Firm* — Viksnins Harris Padys Malen LLP

(57) ABSTRACT

An apparatus including a substrate, a power conversion circuit coupled to the substrate, a power prong coupled to the power conversion circuit, a device connector to couple to a device, and a device connector cable to couple the device connector to the power conversion circuit is disclosed.

8 Claims, 18 Drawing Sheets

(56) References Cited

U.S. PATENT DOCUMENTS

| | | | | |
|---|---|---|---|---|
| 2014/0268464 | A1* | 9/2014 | Dai | H02M 1/32 361/91.1 |
| 2015/0015204 | A1 | 1/2015 | Sorias et al. | |
| 2015/0092314 | A1* | 4/2015 | Kim | H01F 27/29 361/270 |
| 2016/0046199 | A1* | 2/2016 | Butler | B60L 11/1846 320/106 |
| 2016/0204816 | A1* | 7/2016 | Abramovich | H04B 1/3888 455/575.8 |
| 2016/0276944 | A1* | 9/2016 | Guepratte | H05K 1/0233 |
| 2017/0047753 | A1* | 2/2017 | Precheur | H02J 7/0044 |

* cited by examiner

SMALL FORM FACTOR POWER CONVERSION SYSTEM

PRIORITY PARAGRAPH

This application claims priority to U.S. Provisional Application No. 62/248,944 that was filed on Oct. 30, 2015. The entire content of the application referenced above is hereby incorporated by referenced herein.

FIELD

The present disclosure describes a power conversion system having a credit card size form factor.

BACKGROUND

Battery based recharging systems having small form factors have been developed. However, small form factor systems that convert alternating current to direct current for recharging devices, such as cell phones, are not readily available. For these and other reasons here is a need for a small form factor recharging system.

SUMMARY

An apparatus of the present disclosure includes a substrate having a substrate surface, a substrate thickness, and an edge. The substrate surface includes a power prong recess, and the substrate thickness is between about three-tenths of a millimeter and about five millimeters. The apparatus further includes a circuit board and a power conversion circuit mounted on the circuit board. The power conversion circuit includes an alternating current input port, an alternating current rectifier, a transformer, a power circuit, a transformer, a feedback controller, and a direct current output port. The transformer is coupled to the direct current output port and the direct current output port provides a substantially stable voltage. The power conversion circuit has a power factor of at least about 0.8 and the power conversion circuit operates using a high frequency switching signal. The apparatus further includes a toroid to couple the alternating current input port to the alternating current rectifier and a plurality of capacitors to couple the alternating current rectifier to the power circuit and the transformer to couple the power circuit to the direct current output port. The feedback controller couples the direct current output port and the transformer to the power circuit. Each of the plurality of capacitors has a height of less than about 2.8 millimeters. The apparatus further includes a power prong coupled to the alternating current port. The power prong when folded into the power prong recess is oriented substantially parallel to the surface and when unfolded is oriented substantially perpendicular to the surface. The apparatus further includes a device connector to couple to a device. The device connector cable couples the device connector to the direct current port and fits into a device connector cable recess.

DESCRIPTION

Figure 1A:
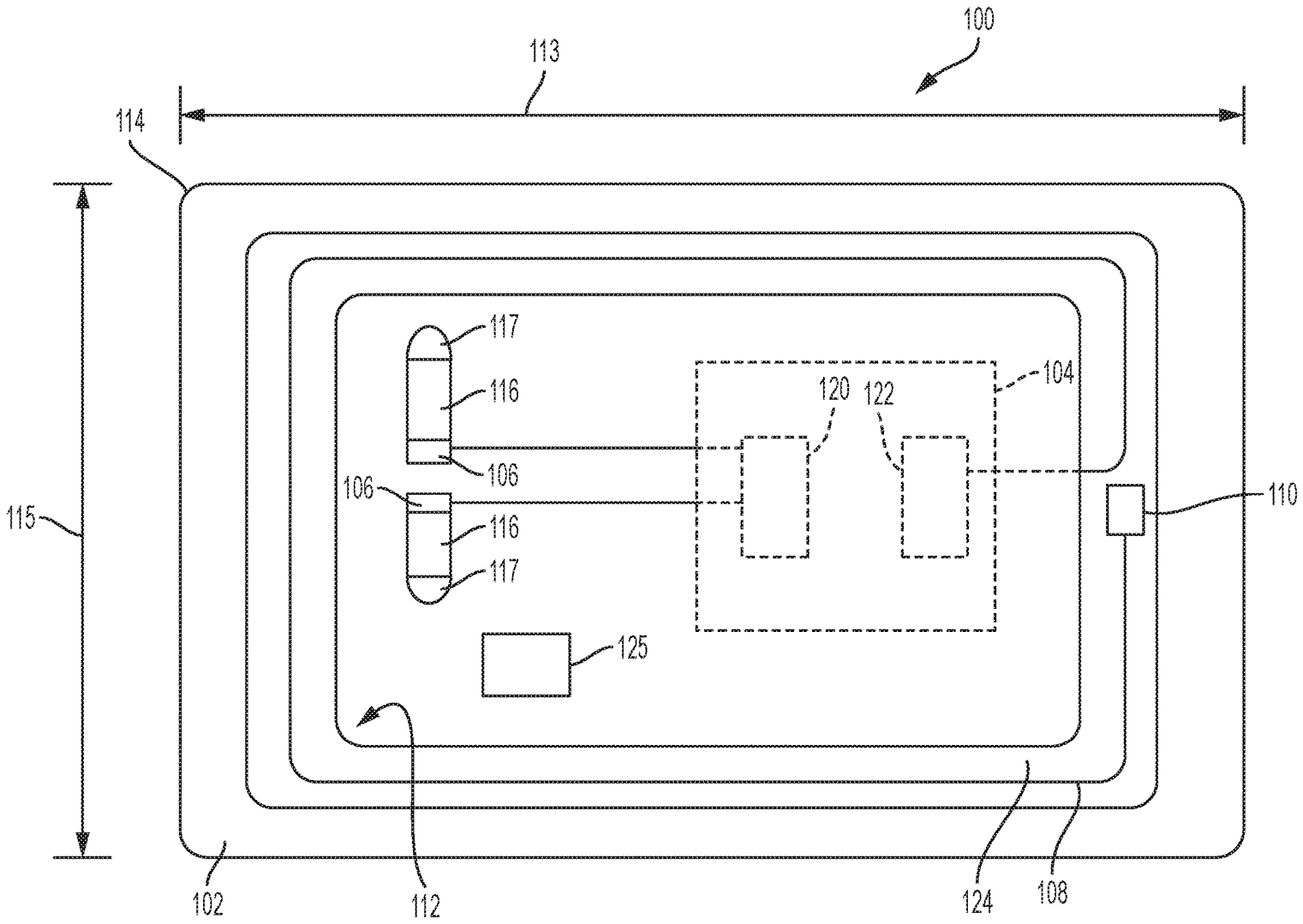
FIG. 1A shows an illustration of a top view of an apparatus including a substrate, a power conversion circuit, a power prong, a device connector cable, and a device connector in accordance with some embodiments of the present disclosure.

FIG. 1A shows an illustration of a top view of an apparatus 100 including a substrate 102, a power conversion circuit 104, a power prong 106, a device connector cable 108, and a device connector 110 in accordance with some embodiments of the present disclosure.

The substrate 102 has a substrate surface 112 and an edge 114. The substrate surface 112 includes a power prong recess 116. The power prong recess 116 is a depression in the substrate surface 112 having a sufficient depth to allow the power prong 106 to rest substantially parallel to the substrate surface 112. In some embodiments, the power prong recess 116 includes a finger recess 117 to assist in unfolding the power prong 106. The finger recess 117 is a slight depression formed at the end of the power prong recess 116 having a shape that enables a human finger to slide below the power prong 106 resting in the power prong recess 116 and rotate the power prong 106 to a substantially vertical position.

The substrate 102 is not limited to being formed from a particular material. In some embodiments, the substrate 102 is formed from a polymer by a molding process, such as injection molding. An exemplary polymer suitable for use in forming the substrate 102 is polyvinyl chloride acetate. In some embodiments, the substrate 102 has a substantially rectangular shape with the edge 114 substantially defining the shape. The substrate 102 also has substantially curved corners. An exemplary length 113 for the substrate 102 is about 85.60 millimeters and an exemplary width 115 for the substrate 102 is about 53.98 millimeters. The substrate 102 may be formed from two halves with the power conversion circuit 104 located between the two halves and coupled to at least one of the two halves.

Figure 1B:
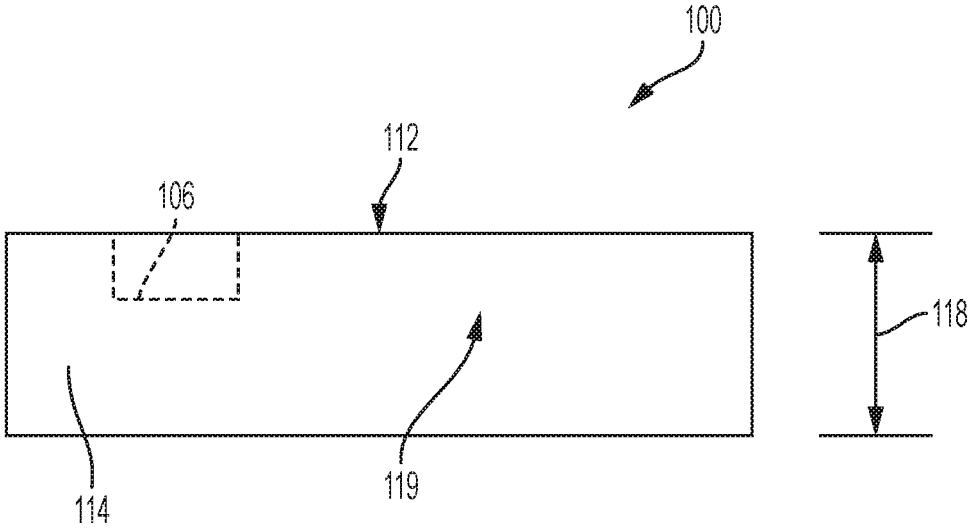
FIG. 1B shows an illustration of a side view of the apparatus shown in FIG. 1A including the edge and a substrate thickness in accordance with some embodiments of the present disclosure.

FIG. 1B shows an illustration of a side view of the apparatus 100 shown in FIG. 1A including the edge 114 and a substrate thickness 118 in accordance with some embodiments of the present disclosure. The edge 114 defines a boundary that separates one portion of the substrate surface 112 including the power prong 106 from another portion of the surface 112 that does not include the power prong 106. The edge 114 includes an edge surface 119.

The substrate thickness 118 is selected to support a particular application. For example, if the substrate 102 is intended to have the form factor of a credit card to provide for easy insertion and removal from a wallet, then the substrate thickness 118 is selected to have approximately the dimensions of a credit card. The substrate thickness 118 is measured at the approximate center point of the substrate 102. In some embodiments, the substrate thickness 118 is between about three-tenths of a millimeter and about four millimeters. In some embodiments, the substrate thickness 118 is between about three-tenths of a millimeter and about three millimeters. In some embodiments, the substrate thickness 118 is between about three-tenths of a millimeter and about two millimeters. In some embodiments, the substrate thickness 118 is between about eight-tenths of a millimeter and about five millimeters. In some embodiments, the substrate thickness 118 is between about eight-tenths of a millimeter and about four millimeters. In some embodiments, the substrate thickness 118 is between about two millimeters and about three millimeters.

Referring again to FIG. 1A, the power conversion circuit 104 includes an alternating current port 120 and a direct current port 122. The power conversion circuit 104 is coupled to the substrate 102. In operation, the power conversion circuit 104 receives an alternating current signal at the alternating current port 120 and provides a direct current signal at the direct current port 122. An alternating current is a current in which the flow of electrons periodically reverses direction. A direct current circuit is a circuit in which the direction of flow of electrons does not change periodically. The power conversion circuit 104 is not limited to receiving an alternating current signal having a particular value or producing a direct current signal having a particular value. An exemplary alternating current signal has a value of between about 120 volts and about 240 volts. An exemplary direct current signal has a value of about five volts and between about one ampere and about two amperes.

In some embodiments, the power conversion circuit 104 has a power factor of at least about 0.8. The power factor is the ratio of the real power delivered to a load to the apparent power in the system. A load with a high power factor draws less current than a load with a low power factor. The higher currents associated with systems having a low power factor are associated with higher energy loss in the distribution system. Power conversion systems having a higher power factor are more efficient and waste less power than power conversion systems having a low power factor and are therefore less detrimental to the environment.

A small form factor design seeks to minimize size (especially height) and component count. Typically, such a design would not seek to add components, such as utilizing six capacitors, in order to increase power factor, unless required by law. Either an active circuit or a passive circuit that increases power factor does so by adding components. At least some of the components added would be power circuit components which are among the largest and tallest components in the circuit and would be expected to impact the size and height. A small form factor design would then be expected to have relatively low power factor, like 0.6 to 0.7. A power factor of 0.8 or more would suggest a larger form factor and more expensive design. Thus, a power factor of 0.8 is unexpected in a small form factor design.

The power prong 106 is coupled to the alternating current port 120. The power prong 106 is not limited to being formed from a particular material. A conductive material, such as brass is an exemplary material suitable for use in fabricating the power prong 106.

In operation, the power prong 106 couples an alternating current signal to the alternating current port 120. The power prong 106 when unfolded and inserted into an alternating current power outlet delivers an alternating current signal to the alternating current port 120 of the power conversion circuit 104. The power prong 106 when folded into the power prong recess 116 is oriented substantially parallel to the substrate surface 112 and when unfolded is oriented substantially perpendicular to the substrate surface 112. In some embodiments, the power prong recess 116 includes the finger recess 117 to assist in unfolding the power prong 106.

The device connector cable 108 couples the direct current port 122 to the device connector 110. In operation, the device connector cable 108 couples power from the direct current port 122 to a device, such as a cell phone, coupled to the device connector 110. The device connector cable 108 is not limited to a particular type of cable and the device connector 110 is not limited to a particular type of connector. The device connector cable 108 and the device connector 110 are selected to meet the requirements of the application. In some embodiments, the device connector cable 108 functions as a Universal Serial Bus (USB) and the device connector 110 is a USB connector. In some embodiments, the device connector cable 108 functions as a micro-Universal Serial Bus (micro-USB) and the device connector 110 is a micro-USB connector. In some embodiments, the device connector cable 108 functions as a Lightning® cable and the device connector 110 is a Lightning® cable connector. The device connector cable 108 fits into a device connector cable recess 124. The device connector cable recess 124 is not limited to being located on the substrate surface 112. In some embodiments, the device connector cable recess 124 is located on the edge 114 (shown below in FIG. 1I).

In some embodiments, a tracker 125 is included in the substrate 102. The tracker 125 provides a location service through wireless communication. In operation, the tracker 125 is programmed to send a signal that is forwarded to a cell phone, such as the apparatus owner's cell phone, when the apparatus is a particular distance from the cell phone. For example, the tracker 125 may be programmed to send a separation signal when the distance between the tracker and the owner's cell phone is more than about one hundred meters.

Figure 1C:
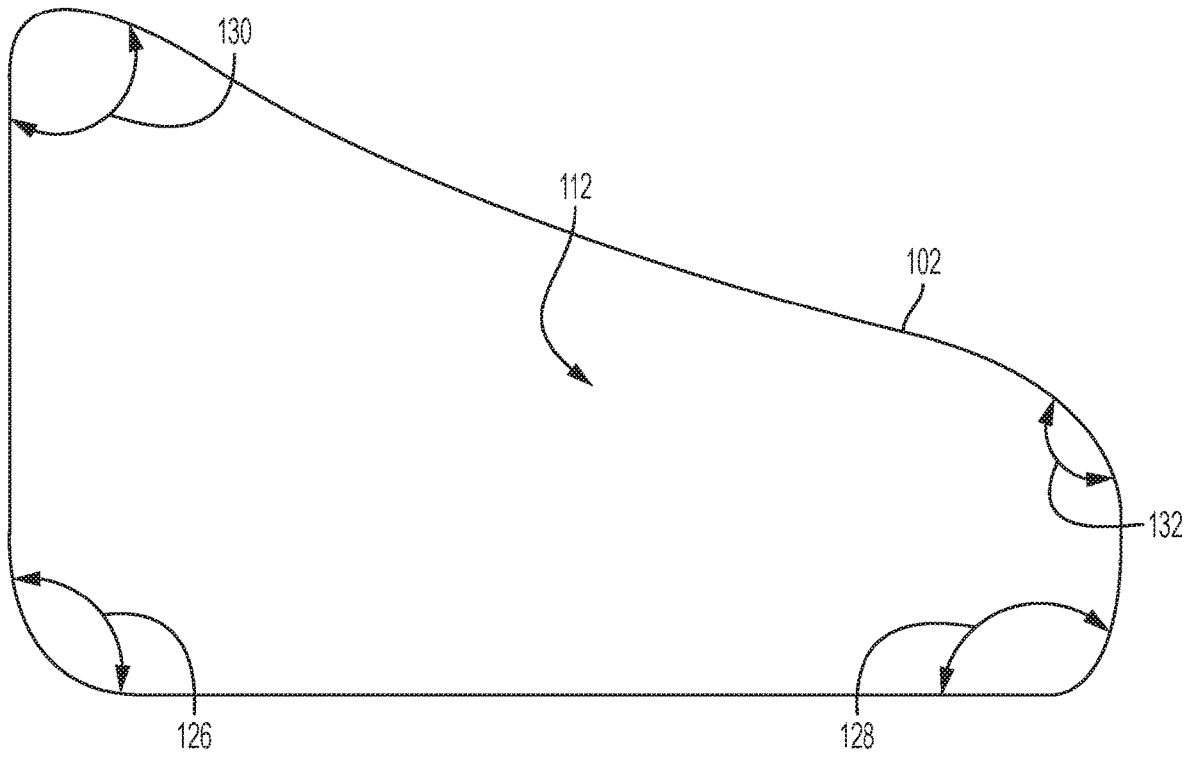
FIG. 1C shows an illustration of the substrate shown in FIG. 1A and having a substantially quadrilateral shape in accordance with some embodiments of the present disclosure.

FIG. 1C shows an illustration of the substrate 102 shown in FIG. 1A and having a substantially quadrilateral shape in accordance with some embodiments of the present disclosure. The substrate surface 112 is substantially flat and has a substantially quadrilateral shape including a first internal angle of about 90 degrees 126 and a second internal angle of about 90 degrees 128. A quadrilateral shape is a polygon with four edges and four vertices. Thus, the substrate 102 has two internal angles of about 90 degrees. The substrate 102 also has a first internal angle of less than about 90 degrees 130 and a second internal angle of more than about 90 degrees 132. Thus, the substrate 102 has one internal angle of less than about 90 degrees and one internal angle of more than about 90 degrees.

Figure 1D:
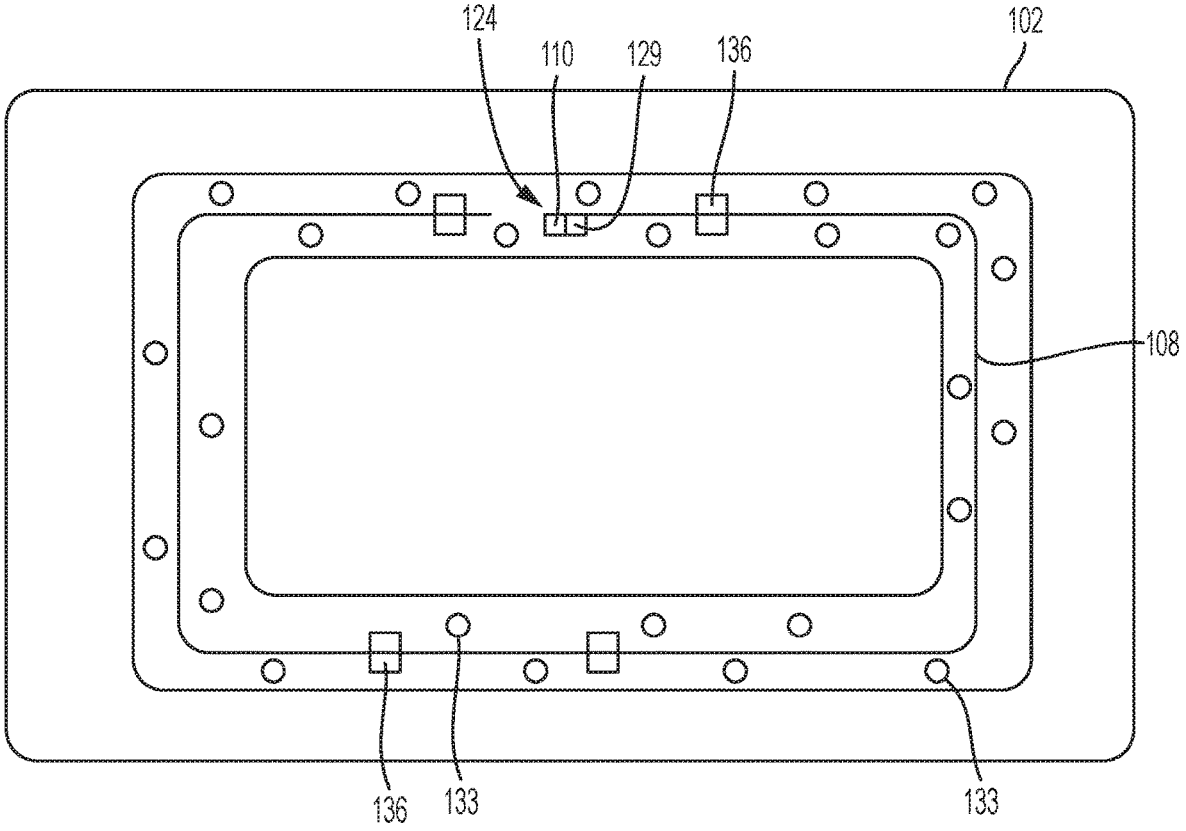
FIG. 1D shows an illustration of the substrate shown in FIG. 1A and having a magnetic coupling capability for the device connector cable in accordance with some embodiments of the present disclosure.

FIG. 1D shows an illustration of the substrate 102 having a magnetic coupling capability for the device connector cable 108 in accordance with some embodiments of the present disclosure. In some embodiments, the device connector cable recess 124 includes a ferromagnetic material 133 and the device connector cable 108 includes one or more magnets 136 to couple the device connector cable 108 to the device connector cable recess 124. In some embodiments, the ferromagnetic material 133 is magnetized and the device connector cable 108 includes a ferromagnetic material to couple to the magnetized ferromagnetic material. In some embodiments, a device connector magnet is coupled to the device connector 110.

Figure 1E:
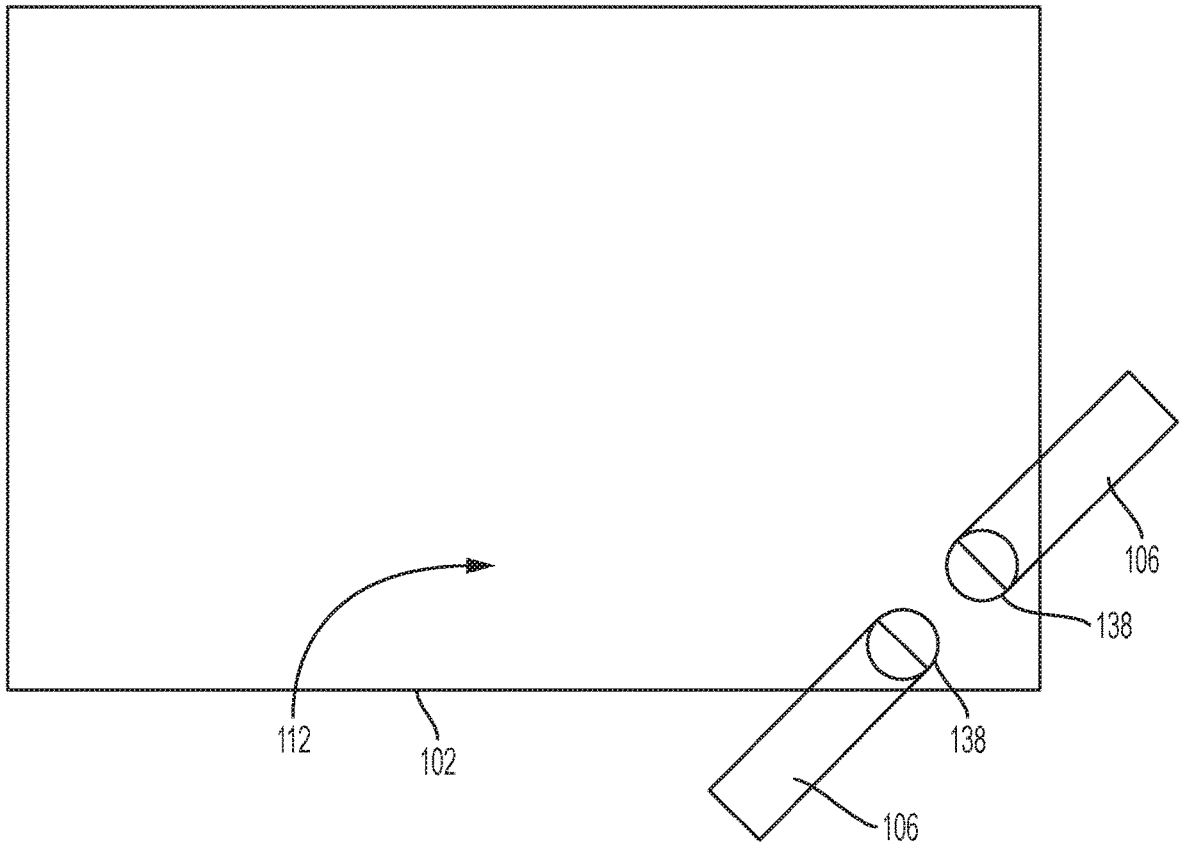
FIG. 1E shows an illustration of the substrate including a rotatable mount coupled to the substrate surface in accordance with some embodiments of the present disclosure

FIG. 1E shows an illustration of the substrate 102 including a rotatable mount 138 coupled to the substrate surface 112 in accordance with some embodiments of the present disclosure. The rotatable mount 138 is configured to receive the power prong 106. In operation, the power prong 106 is lifted from a horizontal position resting in the power prong recess 116 (shown in FIG. 1A). The rotatable mount 138 is rotated to move the power prong 106 to the desired position. And the power prong 106 is lifted to a substantially vertical position with respect to the substrate surface 112.

Figure 1F:
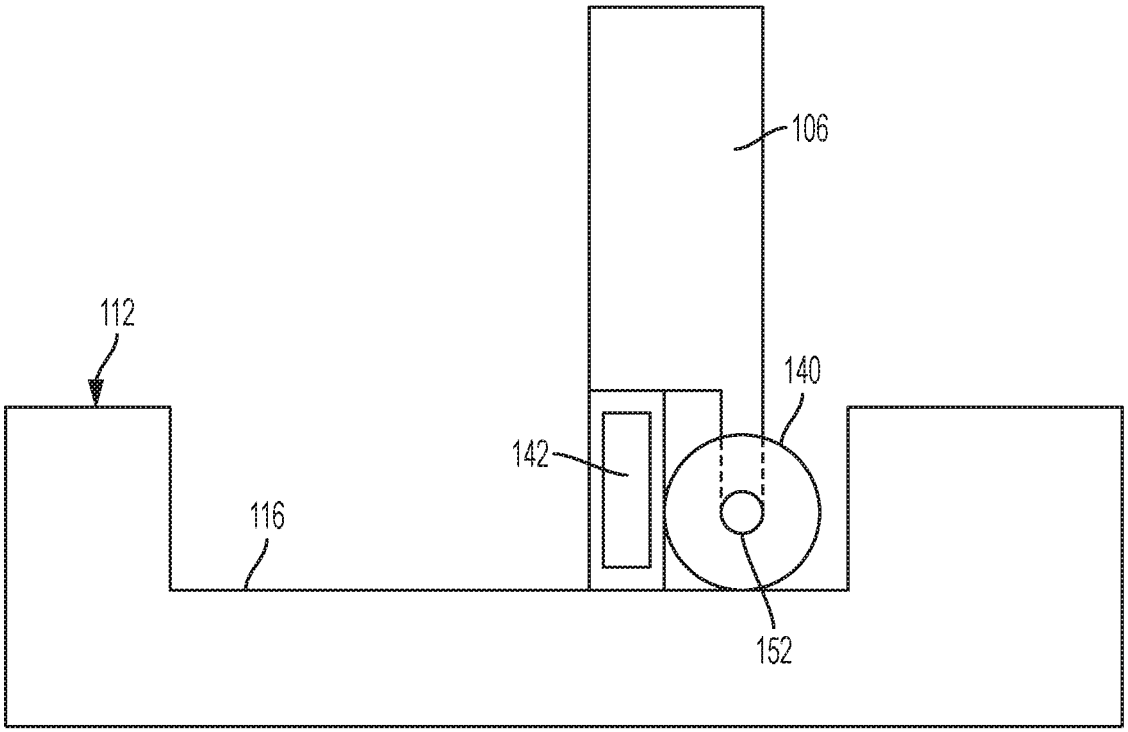
FIG. 1F shows an illustration of the power prong shown in FIG. 1 and further including a spring and a sliding wedge in accordance with some embodiments of the present disclosure.

FIG. 1F shows an illustration of the power prong 106 further including a spring 140 and a sliding wedge 142 in accordance with some embodiments of the present disclosure. The spring 140 wraps around the cylindrical member 152 (shown in FIG. 1H). The spring 140 holds the power prong 106 in a substantially horizontal position with respect to the substrate surface 112 while the power prong 106 rests in the power prong recess 116 and the sliding wedge 142 substantially locks the power prong 106 in a vertical position with respect to the substrate surface 112 when the power prong 106 is rotated to a substantially vertical position with respect to the substrate surface 112 and the sliding wedge 142 is slid into place.

Figure 1G:
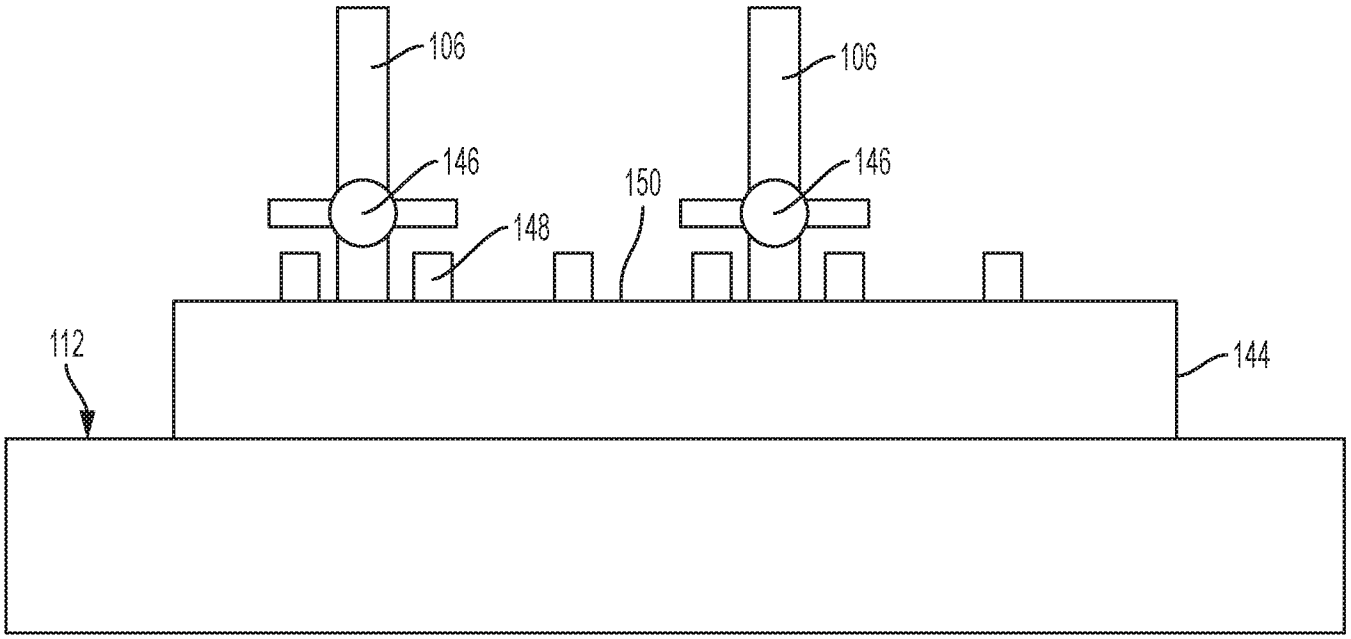
FIG. 1G shows an illustration of the power prong shown in FIG. 1 and further including a sliding member coupled to the substrate surface and a gear coupled to the power prong in accordance with some embodiments of the present disclosure.

FIG. 1G shows an illustration of the power prong 106 further including a sliding member 144 coupled to the substrate surface 112 and a gear 146 coupled to the power prong 106 in accordance with some embodiments of the present disclosure. The sliding member 144 includes one or more teeth 148 and grooves 150. The one or more teeth 148 engage the gear 146 to enable movement of the power prong 106 between a substantially horizontal position with respect to the substrate surface 112 and a substantially vertical position with respect to the substrate surface 112.

Figure 1H:
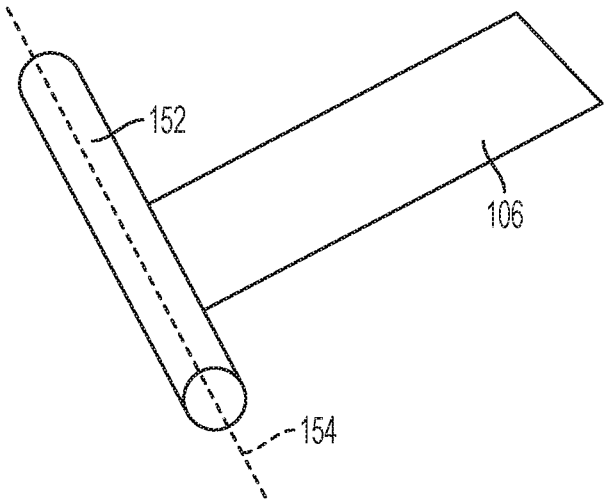
FIG. 1H shows an illustration of the power prong shown in FIG. 1 further including a substantially cylindrical member having a cylindrical member axis in accordance with some embodiments of the present disclosure.

FIG. 1H shows an illustration of the power prong 106 shown in FIG. 1 and further including a substantially cylindrical member 152 having a cylindrical member axis 154 in accordance with some embodiments of the present disclosure. The substantially cylindrical member 152 is coupled to the power prong 106. The power prong 106 rotates about the cylindrical member axis 154 during unfolding and folding of the power prong 106.

Figure 1I:
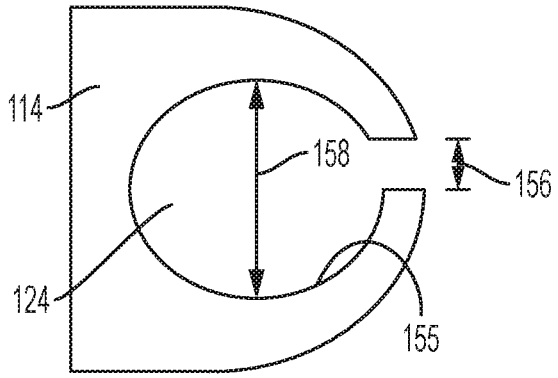
FIG. 1I shows an illustration of a cross-section of the edge (shown in FIG. 1B) and further including the device connector cable recess in accordance with some embodiments of the present disclosure.

FIG. 1I shows an illustration of a cross-section of the edge 114 (shown in FIG. 1B) and further including the device connector cable recess 124 in accordance with some embodiments of the present disclosure. The device connector cable recess 124 is a substantially c-shaped indentation 155 in the edge 114. The c-shaped indentation 155 functions as a clamp that retains the device connector cable 108. The device connector cable recess 124 retains the device connector cable 108 (shown in FIG. 1A) by having an opening with an opening dimension 156 that is narrower than a recess dimension 158 which substantially represents the diameter of the device connector cable recess 124.

Figure 1J:
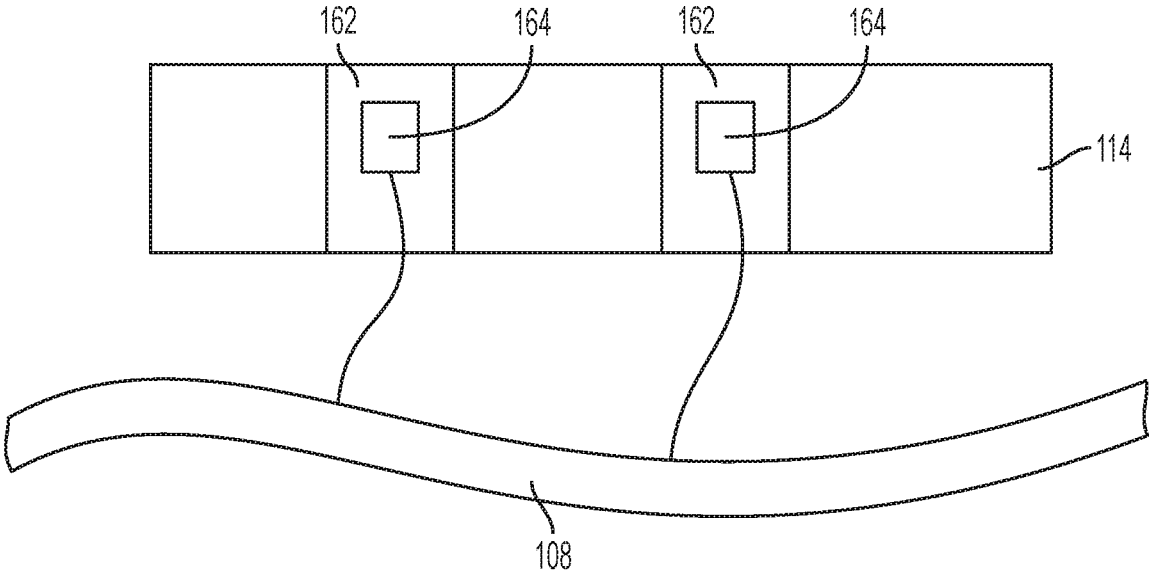
FIG. 1J shows an illustration of the edge (shown in FIG. 1B) and further including one or more edge mounted cable connectors.

FIG. 1J shows an illustration of the edge 114 (shown in FIG. 1A) and further including one or more edge mounted cable connectors 162. Each of the one or more edge mounted cable connectors 162 couple to a complementary cable mounted edge connector 164 connected to the device connector cable 108. Exemplary cable connectors 162 and cable mounted edge connectors 164 include snap-connectors. Snap-connectors are characterized by requiring a small insertion and removal force.

Figure 1K:
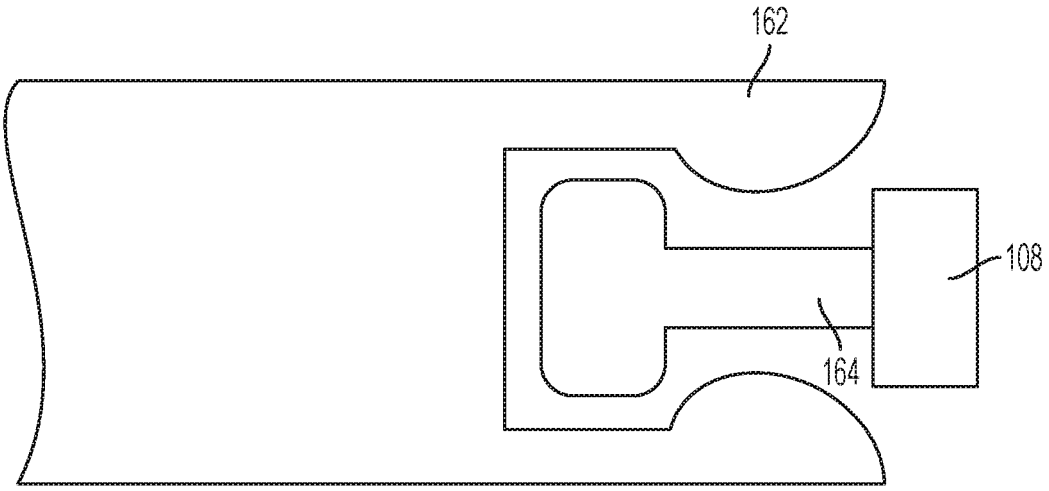
FIG. 1K shows an illustration of the cable connector and the cable mounted edge connector in accordance with some embodiments of the present disclosure.

FIG. 1K shows an illustration of the cable connector 162 and the cable mounted edge connectors 164 in accordance with some embodiments of the present disclosure. The edge 114 (shown in FIG. 1A) includes the cable connector 162 which forms a coupling space for the cable mounted edge connector 164. In operation, the cable mounted edge connector 164, which is slightly larger than the opening of the cable connector 162, press fits through the opening of the cable connector 162 to couple the device connector cable 108 to the substrate 102 (shown in FIG. 1A). The cable connector 162 is designed to be flexible enough so insertion and removal of the cable mounted edge connector 164 into and out of the cable connector 162 requires only a small force. The cable connector 162 and the cable mounted edge connector 164 also include substantially smooth surfaces for easy insertion and removal of the cable mounted edge connector 164 from the cable connector 162.

Figure 1L:
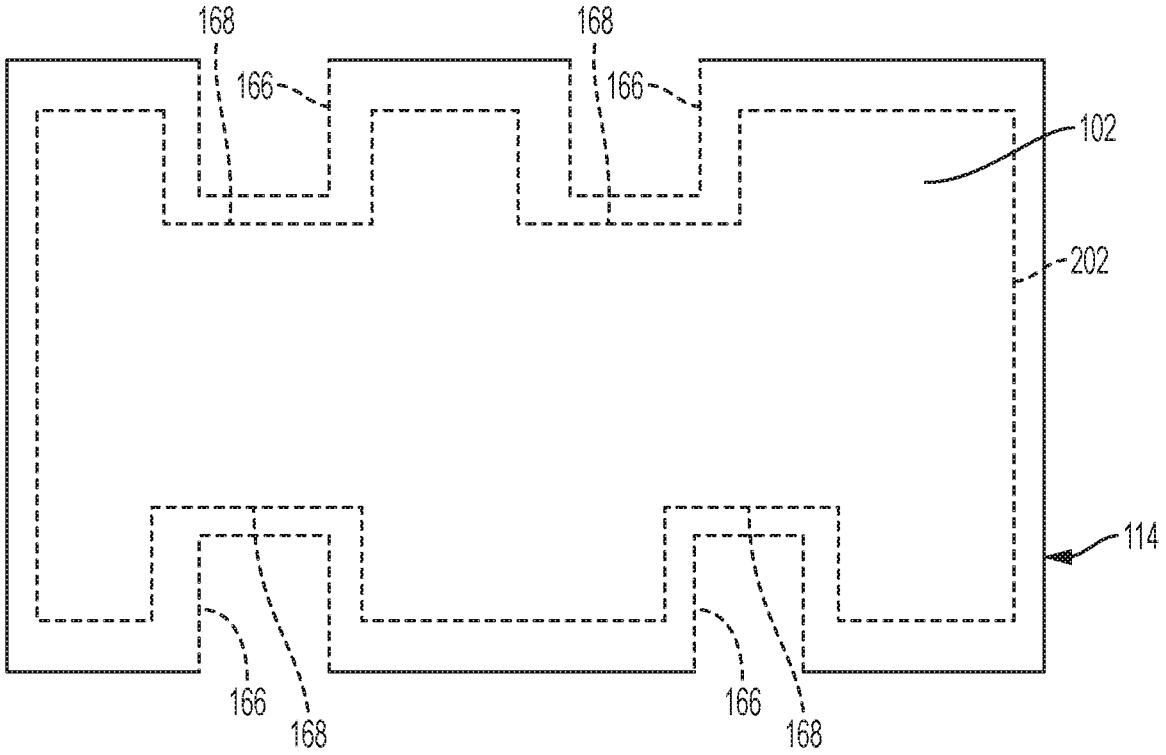
FIG. 1L shows a top view illustration of the substrate (shown in FIG. 1A) and a plurality of cable connector sites identifying locations on the edge (shown in FIG. 1A) for the cable connector.

FIG. 1L shows a top view illustration of the substrate 102 (shown in FIG. 1A) and a plurality of cable connector sites 166 identifying locations on the edge 114 (shown in FIG. 1A) for the cable connector 162. The circuit board 202 (shown in FIG. 2) includes a perimeter having a plurality of perimeter indentations 168 substantially corresponding to the plurality of cable connector sites 166.

Figure 2A:
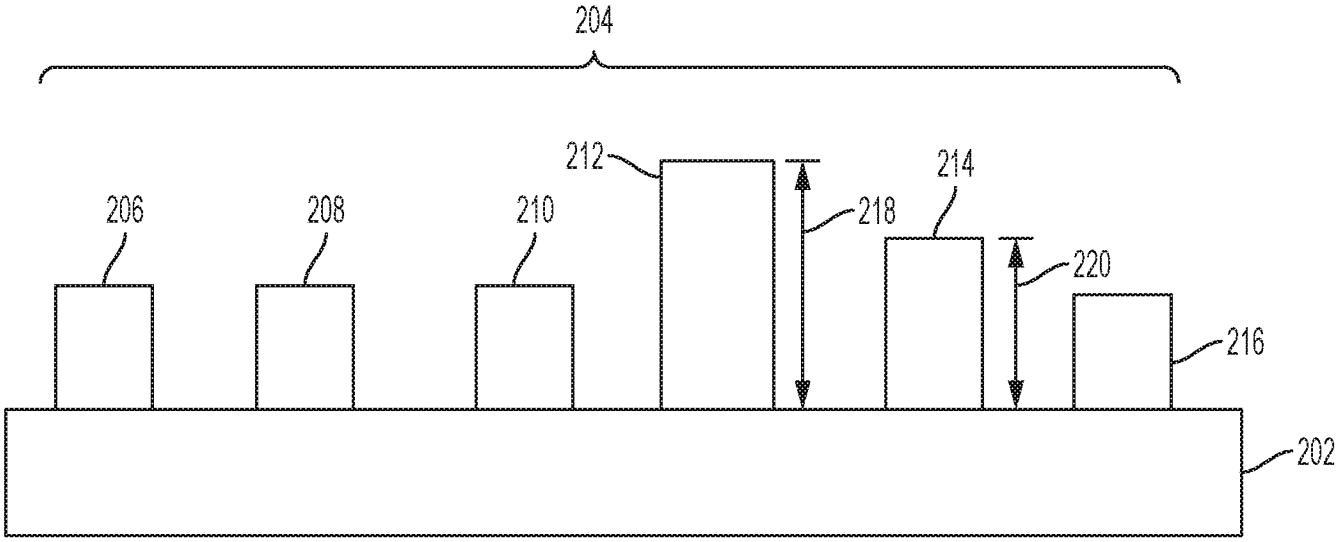
FIG. 2A shows an illustration of an apparatus including a circuit board and a power conversion circuit in accordance with some embodiments of the present disclosure.

FIG. 2A shows an illustration of an apparatus 200 including a circuit board 202 and a power conversion circuit 204 in accordance with some embodiments of the present disclosure. The power conversion circuit 204 is mounted on the circuit board 202. The power conversion circuit 204 includes an alternating current input port 206, a toroid 208, an alternating current rectifier 210, a plurality of capacitors 212, a transformer 214, and a direct current output port 216.

In operation, the direct current output port 216 provides a substantially stable voltage. The power conversion circuit 204 has a power factor of at least about 0.8 and the power conversion circuit 204 operates using a high frequency switching signal. In some embodiments, the high frequency switching signal has a frequency of about one megahertz. In some embodiments, the high frequency switching signal has a frequency of between about five-tenths megahertz and about one megahertz. In some embodiments, the high frequency switching signal has a frequency of between about one megahertz and about one and one-half megahertz.

Each of the plurality of capacitors 212 has a capacitor height 218 of less than about 2.8 millimeters. In some embodiments, the transformer 214 has a transformer height 220 of between about 1.0 millimeter and about 3.2 millimeters. The power conversion circuit 204 has a power conversion circuit thickness 222 that is less than the substrate thickness 118 (shown in FIG. 1A).

Figure 2B:
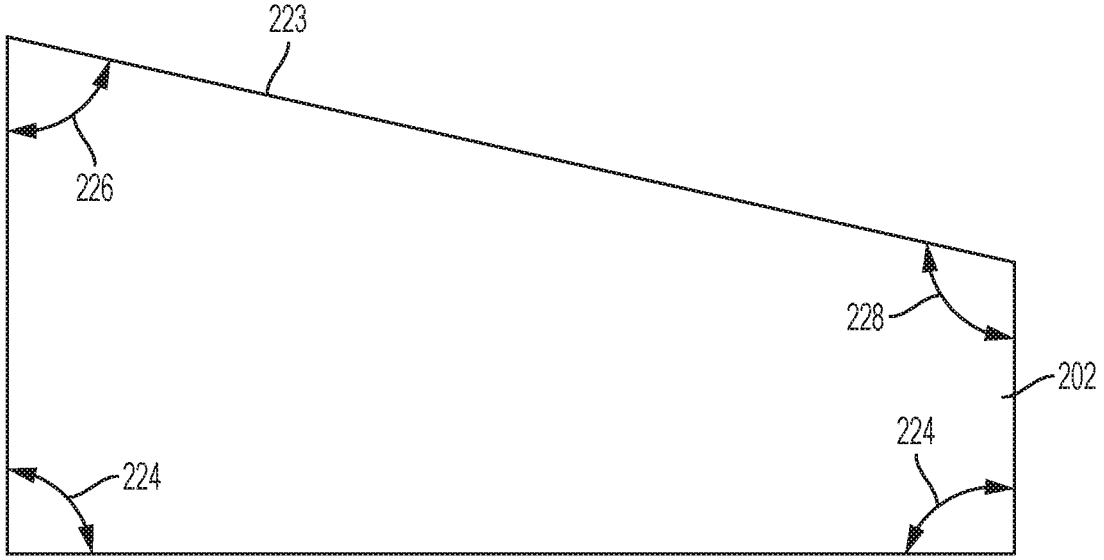
FIG. 2B shows a top view illustration of the circuit board (shown in FIG. 2A) having a substantially quadrilateral shape in accordance with some embodiments of the present disclosure.

FIG. 2B shows a top view illustration of the circuit board 202 (shown in FIG. 2A) having a substantially quadrilateral shape 223 in accordance with some embodiments of the present disclosure. In some embodiments, the circuit board 202 includes two internal angles 224 of about 90 degrees each, one internal angle 226 of less than about 90 degrees, and one internal angle 228 of more than about 90 degrees.

Figure 2C:
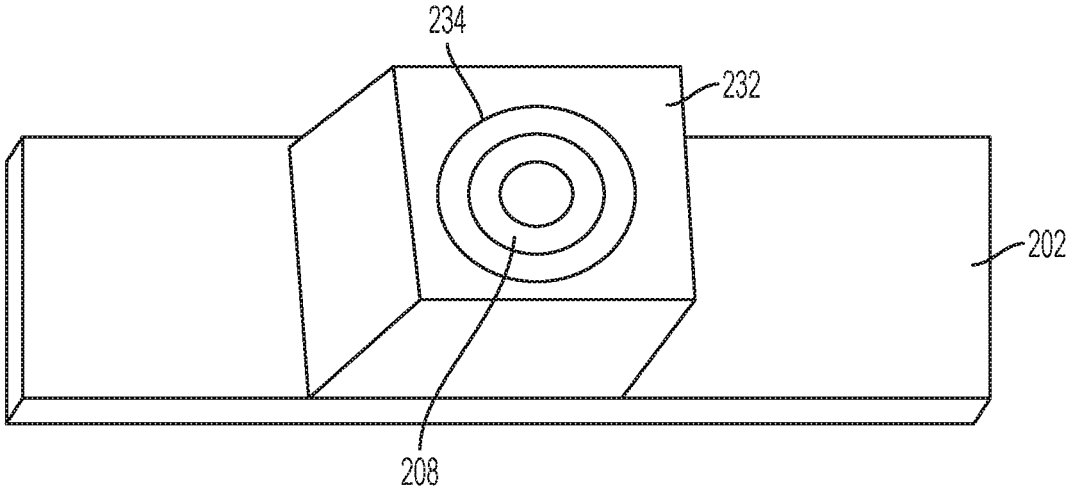
FIG. 2C shows an illustration of a toroid mounting board mounted on the circuit board in accordance with some embodiments of the present disclosure.

FIG. 2C shows an illustration of a toroid mounting board 232 mounted on the circuit board 202 in accordance with some embodiments of the present disclosure. The toroid mounting board 232 has a hole 234. The toroid 208 (shown in FIG. 2A) is mounted in the hole 234.

Figure 3:
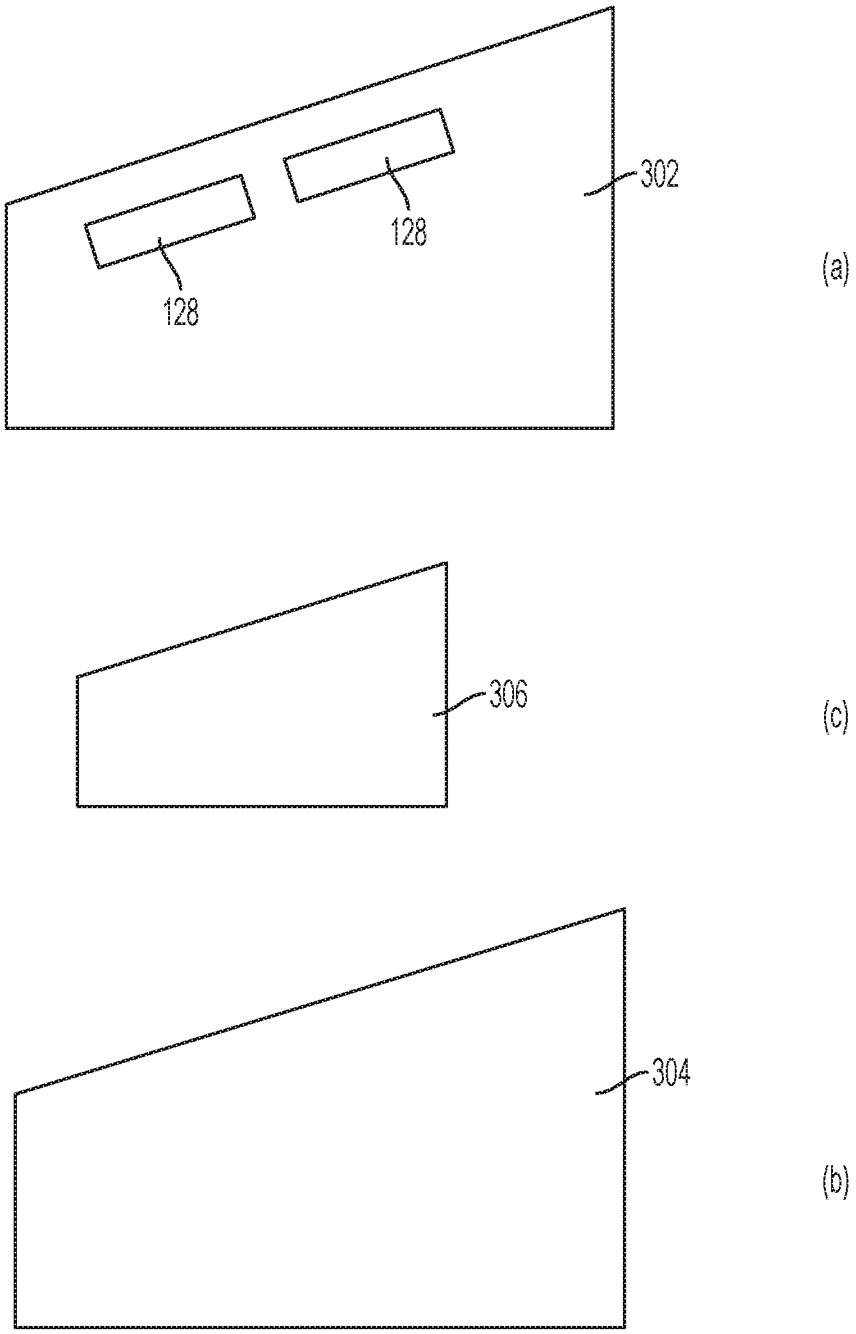
FIG. 3 shows a top view illustration of a first substrate assembly piece (FIG. 3(*a*)) including the power prong recess (shown in FIG. 1A), a second substrate assembly piece 304 (FIG. 3(*b*), and a circuit board 306 (FIG. 3(*c*)) in accordance with some embodiments of the present disclosure.

FIG. 3 shows a top view illustration of a first substrate assembly piece 302 (FIG. 3(*a*)) including the power prong recess 128 (shown in FIG. 1), a second substrate assembly piece 304 (FIG. 3(*b*), and a circuit board 306 (FIG. 3(*c*)) in accordance with some embodiments of the present disclosure. When coupled together the first substrate assembly piece 302 and the second substrate assembly piece 304 form the substrate 102 (shown in FIG. 1) After assembly, the circuit board 306 is located substantially between the first substrate assembly piece 302 and the second substrate assembly piece 304.

The first substrate assembly piece 302 and the second substrate assembly piece 304 can be formed by an injection molding process. The circuit board 306 can be coupled to either the first substrate assembly piece 302 or the second substrate assembly piece 304. Finally, the first substrate assembly piece 302 can be coupled to the second substrate assembly piece 304 with the circuit board 306 located between the first substrate assembly piece 302 and the second substrate assembly piece 304.

Figure 4:
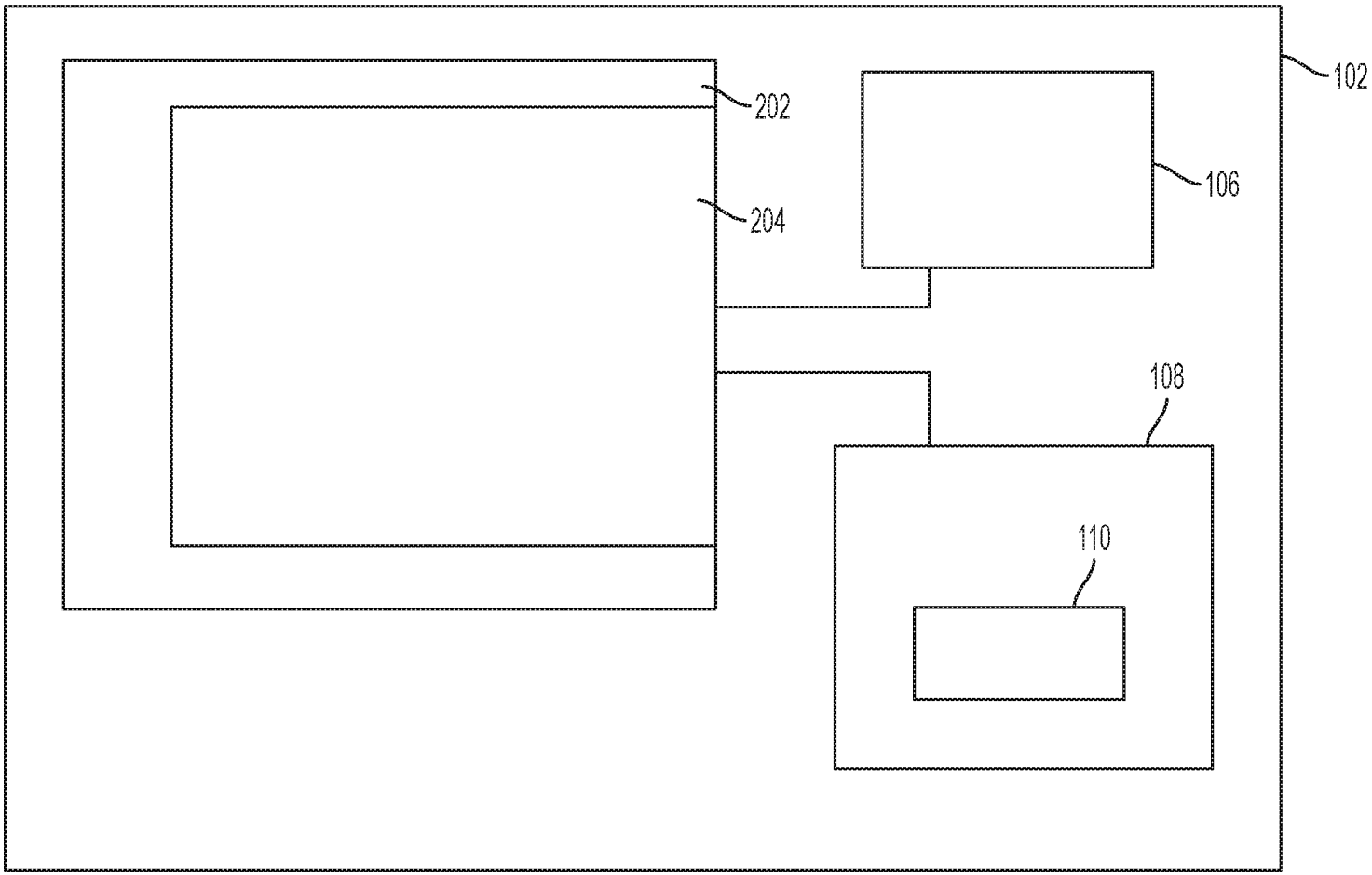
FIG. 4 shows a block diagram of an apparatus in accordance with some embodiments of the present disclosure.

FIG. 4 shows a block diagram of an apparatus 400 in accordance with some embodiments of the present disclosure. The apparatus 400 includes the substrate 102 (shown in FIG. 1A), the circuit board 202 (shown in FIG. 2A), the power conversion circuit 204 (shown in FIG. 2A), the toroid 208 (shown in FIG. 2A), the plurality of capacitors 212 (shown in FIG. 2A), the power prong 106 (shown in FIG. 1A), the device connector 110 (shown in FIG. 1A), and the device connector cable 108 (shown in FIG. 1A).

Figure 5:
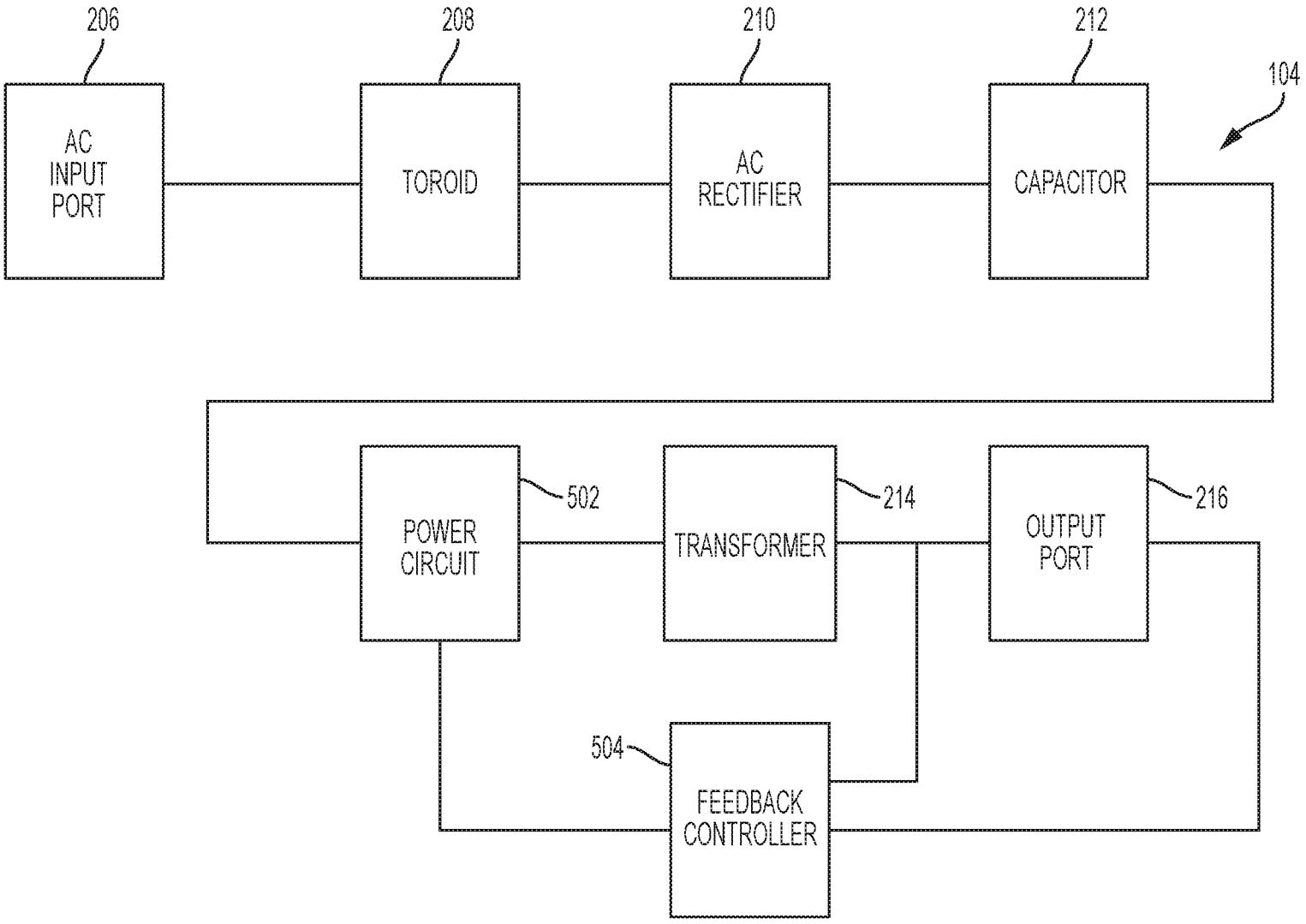
FIG. 5 shows a block diagram of the power conversion circuit (shown in FIG. 1A) in accordance with some embodiments of the present disclosure.

FIG. 5 shows a block diagram of the power conversion circuit 104 (shown in FIG. 1A) in accordance with some embodiments of the present disclosure. The power conversion circuit 104 includes an alternating current input port 206, a toroid 208, an alternating current rectifier 210, a plurality of capacitors 212, a power circuit 502, a transformer 214, an output port 216, and a feedback controller 504. The alternating current input port 106 is coupled to the toroid 208. The toroid 208 is coupled to the alternating current rectifier 210. The alternating current rectifier 210 is coupled to the plurality of capacitors 212. The plurality of capacitors 212 is coupled to the power circuit 502. The power circuit 502 is coupled to the transformer 214. The transformer 214 is coupled to the output port 216 and the feedback controller 504. The output port 216 is coupled to the feedback controller 504. The output of the feedback controller 504 is coupled to the power circuit 502. In some embodiments, the power conversion circuit 104 is a switching-mode power supply. A switching-mode power supply utilizes a power circuit, such as the power circuit 502, that is switched on and off at a high frequency by the feedback controller 504. In some embodiments, the feedback controller 504 switches the power circuit 502 at a frequency of about one megahertz.

In operation the alternating current input port 206 receives an alternating current signal. In some embodiments, the alternating current signal has a value of between about 220 and about 240 volts and a frequency of between about 50 hertz and 60 hertz. The toroid 208 functions as an electromagnetic interference filter and prevents noise from being fed back into the alternating current source. The alternating current rectifier 208 converts the alternating current signal to a direct current signal. The plurality of capacitors 212 store energy from the rectifier 210. In some embodiments, the plurality of capacitors 212 include six 35 volt/33 microfarad capacitors. The six capacitors are connected in series. The power circuit 502 under control of the feedback controller 504 provides a switched signal to the transformer 214. The switched signal switches between a high voltage signal and a substantially zero voltage signal. The transformer 214 transfers energy from the power circuit 502 to the direct current output port 216 and steps down the voltage. In some embodiments, the direct current output port 216 includes a filter, such as a low pass filter to produce a stable direct current signal having a value of about five volts and a current of between about one ampere and about two amperes. The feedback controller 504 receives the direct current signal and the transformer signal and generates a switching signal to control the power circuit 502 that delivers pulses of energy to the transformer 214. In some embodiments, the switching signal changes state at a frequency of about one megahertz.

Reference throughout this specification to "an embodiment," "some embodiments," or "one embodiment." means that a particular feature, structure, material, or characteristic described in connection with the embodiment is included in at least one embodiment of the present disclosure. Thus, the appearances of the phrases such as "in some embodiments," "in one embodiment," or "in an embodiment," in various places throughout this specification are not necessarily referring to the same embodiment of the present disclosure. Furthermore, the particular features, structures, materials, or characteristics may be combined in any suitable manner in one or more embodiments.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An apparatus comprising:

a substrate having a substrate surface, a substrate thickness, and an edge, the substrate surface including a power prong recess, and the substrate thickness being between about three-tenths of a millimeter and about five millimeters;

a power conversion circuit including an alternating current port and a direct current port, the power conversion circuit coupled to the substrate, and the power conversion circuit having a power conversion circuit thickness less than the substrate thickness;

a power prong coupled to the alternating current port, the power prong when folded into the power prong recess oriented substantially parallel to the substrate surface and when unfolded oriented substantially perpendicular to the substrate surface;

a device connector to couple to a device; and a device connector cable to couple the device connector to the direct current port and to fit into a device connector cable recess, wherein the substrate surface has a substantially quadrilateral perimeter including two internal angles of about 90 degrees each, one internal angle of less than about 90 degrees and one internal angle of more than about 90 degrees.

2. An apparatus comprising:

a circuit board;

a power conversion circuit mounted on the circuit board, the power conversion circuit including an alternating current input port, a toroid, an alternating current rectifier, a plurality of capacitors, a power circuit, a transformer, a direct current output port, and a feedback controller, the transformer coupled to the direct current output port and the direct current output port to provide a substantially stable voltage, the power conversion circuit having a power factor of at least about 0.8 and the power conversion circuit to operate using a high frequency switching signal, the toroid to couple the alternating current input port to the alternating current rectifier, and the plurality of capacitors to couple the alternating current rectifier to the power circuit, and the transformer to couple the power circuit to the direct current output port, and the feedback controller to couple the direct current output port and the transformer to the power circuit, each of the plurality of capacitors having a capacitor height of less than about 2.8 millimeters; and a toroid mounting board mounted on the circuit board and the toroid mounting board having a hole with the toroid mounted in the hole.

3. The apparatus of claim 2, wherein the transformer has a transformer height of between about 1.0 millimeter and about 3.2 millimeters.

4. An apparatus comprising:

a substrate including a first substrate assembly piece and a second substrate assembly piece and having a substrate surface, a substrate thickness, and an edge, the substrate surface including a power prong recess, and the substrate thickness being between about three-tenths of a millimeter and about five millimeters;

a circuit board located between the first substrate assembly piece and the second substrate assembly piece and attached to at least one of the first assembly piece and the second assembly piece;

a power conversion circuit mounted on the circuit board, the power conversion circuit including an alternating current input port, an alternating current rectifier, a power circuit, a transformer, a feedback controller, and a direct current output port, the transformer coupled to the direct current port and the direct current output port to provide a substantially stable voltage, the power conversion circuit having a power factor of at least about 0.8 and the power conversion circuit to operate using a high frequency switching signal;

a toroid to couple the alternating current input port to the alternating current rectifier;

a plurality of capacitors to couple the alternating current rectifier to the power circuit, the transformer to couple the power circuit to the direct current output port, and a feedback controller to couple the direct current output port and the transformer to the power circuit, each of the plurality of capacitors having a height of less than about 2.8 millimeters;

a power prong coupled to the alternating current port, the power prong when folded into the power prong recess oriented substantially parallel to the surface and when unfolded oriented substantially perpendicular to the surface;

a device connector to couple to a device; and a device connector cable to couple the device connector to the direct current port and to fit into a device connector cable recess, wherein the substrate surface has a substantially quadrilateral shape including two internal angles of about 90 degrees each, a first internal angle of less than about 90 degrees and a second internal angle of more than about 90 degrees.

5. The apparatus of claim 4, the power conversion circuit to receive a signal of between about 120 volts and 240 volts and to provide a signal of about five volts and about two amperes.

6. An apparatus comprising:

a substrate including a first substrate assembly piece and a second substrate assembly piece and having a substrate surface, a substrate thickness, and an edge, the substrate surface including a power prong recess, and the substrate thickness being between about three-tenths of a millimeter and about five millimeters;

a circuit board located between the first substrate assembly piece and the second substrate assembly piece and attached to at least one of the first assembly piece and the second assembly piece;

a power conversion circuit mounted on the circuit board, the power conversion circuit including an alternating current input port, an alternating current rectifier, a power circuit, a transformer, a feedback controller, and a direct current output port, the transformer coupled to the direct current port and the direct current output port to provide a substantially stable voltage, the power conversion circuit having a power factor of at least about 0.8 and the power conversion circuit to operate using a high frequency switching signal;

a toroid to couple the alternating current input port to the alternating current rectifier;

a plurality of capacitors to couple the alternating current rectifier to the power circuit, the transformer to couple the power circuit to the direct current output port, and a feedback controller to couple the direct current output port and the transformer to the power circuit, each of the plurality of capacitors having a height of less than about 2.8 millimeters;

a power prong coupled to the alternating current port, the power prong when folded into the power prong recess oriented substantially parallel to the surface and when unfolded oriented substantially perpendicular to the surface;

a device connector to couple to a device; and a device connector cable to couple the device connector to the direct current port and to fit into a device connector cable recess, wherein the substrate has a length of about 85.60 millimeters and a width of about 53.98 millimeters, wherein the printed circuit board has a substantially quadrilateral printed circuit board shape including two internal angles of about 90 degrees each, a first internal angle of less than about 90 degrees and a second internal angle of more than about 90 degrees.

7. An apparatus comprising:

a substrate including a first substrate assembly piece and a second substrate assembly piece and having a substrate surface, a substrate thickness, and an edge, the substrate surface including a power prong recess, and the substrate thickness being between about three-tenths of a millimeter and about five millimeters;

a circuit board located between the first substrate assembly piece and the second substrate assembly piece and attached to at least one of the first assembly piece and the second assembly piece;

a power conversion circuit mounted on the circuit board, the power conversion circuit including an alternating current input port, an alternating current rectifier, a power circuit, a transformer, a feedback controller, and a direct current output port, the transformer coupled to the direct current port and the direct current output port to provide a substantially stable voltage, the power conversion circuit having a power factor of at least about 0.8 and the power conversion circuit to operate using a high frequency switching signal;

a toroid to couple the alternating current input port to the alternating current rectifier;

a plurality of capacitors to couple the alternating current rectifier to the power circuit, the transformer to couple the power circuit to the direct current output port, and a feedback controller to couple the direct current output port and the transformer to the power circuit, each of the plurality of capacitors having a height of less than about 2.8 millimeters;

a power prong coupled to the alternating current port, the power prong when folded into the power prong recess oriented substantially parallel to the surface and when unfolded oriented substantially perpendicular to the surface;

a device connector to couple to a device; and a device connector cable to couple the device connector to the direct current port and to fit into a device connector cable recess, wherein the edge includes the device connector cable recess including a clamp.

8. An apparatus comprising:

a substrate including a first substrate assembly piece and a second substrate assembly piece and having a substrate surface, a substrate thickness, and an edge, the substrate surface including a power prong recess, and the substrate thickness being between about three-tenths of a millimeter and about five millimeters;

a circuit board located between the first substrate assembly piece and the second substrate assembly piece and attached to at least one of the first assembly piece and the second assembly piece;

a power conversion circuit mounted on the circuit board, the power conversion circuit including an alternating current input port, an alternating current rectifier, a power circuit, a transformer, a feedback controller, and a direct current output port, the transformer coupled to the direct current port and the direct current output port to provide a substantially stable voltage, the power conversion circuit having a power factor of at least about 0.8 and the power conversion circuit to operate using a high frequency switching signal;

a toroid to couple the alternating current input port to the alternating current rectifier;

a plurality of capacitors to couple the alternating current rectifier to the power circuit, the transformer to couple the power circuit to the direct current output port, and a feedback controller to couple the direct current output port and the transformer to the power circuit, each of the plurality of capacitors having a height of less than about 2.8 millimeters;

a power prong coupled to the alternating current port, the power prong when folded into the power prong recess oriented substantially parallel to the surface and when unfolded oriented substantially perpendicular to the surface;

a device connector to couple to a device; and a device connector cable to couple the device connector to the direct current port and to fit into a device connector cable recess, wherein the edge includes a plurality of edge mounted cable connectors.

* * * * *